US005918771A

United States Patent [19]

van der Heijden

[11] Patent Number: 5,918,771

[45] Date of Patent: Jul. 6, 1999

[54] AEROSOL INTENDED FOR DISPENSING A MULTI-COMPONENT MATERIAL

[75] Inventor: Edgar I. M. van der Heijden, Alkmaar, Netherlands

[73] Assignee: Airspray International B.V., Beverwijk, Netherlands

[21] Appl. No.: 08/963,271

[22] Filed: Nov. 3, 1997

Related U.S. Application Data

[63] Continuation of application No. PCT/NL97/00028, Jan. 31, 1997, and a continuation of application No. 08/616,895, Mar. 15, 1996, abandoned.

[30] Foreign Application Priority Data

| | | | |
|---|---|---|---|
| Jan. 31, 1996 | [NL] | Netherlands | 1002211 |
| Sep. 26, 1996 | [NL] | Netherlands | 1004121 |
| Oct. 22, 1996 | [NL] | Netherlands | 1004332 |

[51] Int. Cl.[6] ..... B67D 5/52

[52] U.S. Cl. ..... 222/136; 222/190; 222/259

[58] Field of Search ..... 222/135, 136, 222/137, 190, 145.6, 256–259, 389, 394, 385, 321.9

[56] References Cited

U.S. PATENT DOCUMENTS

| | | | |
|---|---|---|---|
| 3,709,437 | 1/1973 | Wright . | |
| 3,813,011 | 5/1974 | Harrison et al. | 222/136 |
| 3,920,158 | 11/1975 | Meshberg | 222/135 |
| 4,949,874 | 8/1990 | Fiedler et al. . | |
| 5,271,530 | 12/1993 | Uehira et al. | 222/190 |
| 5,370,272 | 12/1994 | Gueret . | |
| 5,439,141 | 8/1995 | Clark et al. . | |
| 5,568,883 | 10/1996 | Cataneo et al. | 222/526 |

FOREIGN PATENT DOCUMENTS

| | | | |
|---|---|---|---|
| 0 318 834 | 6/1989 | European Pat. Off. . | |
| 0 486 355 | 5/1992 | European Pat. Off. . | |
| 0 613 728 | 9/1994 | European Pat. Off. . | |
| 0 676 339 | 10/1995 | European Pat. Off. . | |
| 1001366 | 4/1997 | Netherlands . | |
| 545 232 | 1/1974 | Switzerland . | |
| WO91/01259 | 2/1991 | WIPO . | |
| 93/04940 | 3/1993 | WIPO | 222/257 |
| WO93/04940 | 3/1993 | WIPO . | |
| WO95/30490 | 11/1995 | WIPO . | |

*Primary Examiner*—Philippe Derakshani
*Attorney, Agent, or Firm*—Lowe Hauptman Gopstein Gilman & Berner

[57] ABSTRACT

Aerosol intended for dispensing several components for the production of a multi-component material comprising a dispensing assembly, a main container and one or more separate auxiliary containers for components to be dispensed, piston pumps, control part, piston chamber and non-return ball check valve.

14 Claims, 9 Drawing Sheets

AEROSOL INTENDED FOR DISPENSING A MULTI-COMPONENT MATERIAL

REFERENCE TO RELATED APPLICATION

This Application is a continuation of U.S. patent application Ser. No. 08/616,895 now abandoned filed Mar. 15, 1996 and International Application No. PCT/NL97/00028, whose International filing date is Jan. 31, 1997, which in turn claims the benefit of Netherland Application No.1002211, filed Jan. 31, 1996; Netherland Application No.1004121 filed Sep. 26, 1996 and Netherland Application No.1004332 filed Oct. 22, 1996, the disclosures of which applications are incorporated by reference herein. The benefit of the filing and priority dates of the U.S., International and Netherland Applications is respectfully requested.

The present invention relates to an aerosol intended for dispensing several components for the production of a multi-component material, in particular a paste-like cosmetic material.

A number of such aerosols are known in the prior art, but they all have different disadvantages.

In this connection attention is drawn to WO-A-93/04940 and WO-A-95/30490. WO-A-93/04940 discloses an aerosol for dispensing two liquid materials from two concentric containers with variable volume, namely a main container and an auxiliary container. The containers comprise a freely movable piston at one end thereof, so that the volume of liquid material drawn from the containers need not be replenished with air from the environment. In addition, the aerosol comprises a dispensing assembly with two concentric piston pumps and a common control part. The piston pumps each comprise a piston chamber with an inlet and an outlet and a piston which is movable therein. The inlets and outlets are provided with non-return valves, in order to permit the passage of liquid material in only one direction.

Preloaded sealing rings and valve flaps are used as the non-return valves, but in practice these are found to be unreliable non-return valves. This makes it difficult to set the ratio between the components to be dispensed.

Moreover, the construction of the aerosol as a whole makes it impossible to remove the dispensing assembly with the auxiliary container from the main container, for example in order to permit the insertion of another auxiliary container into the main container, so that at a desired moment another combination of components to be dispensed can be used, or in order to permit the fitting of the auxiliary container prior to the first use. The technical standards set for the outer container mean that there is little freedom as regards the design of the outside of the aerosol.

WO-A-95/30490 discloses an aerosol for dispensing two components, which comprises a main container for one component and an auxiliary container for the other component, and also a dispensing assembly. Just as in the case of WO-A-93/04940, the dispensing assembly comprises a common control part for two concentric piston pumps, each with a piston chamber and a piston which is movable therein, each piston chamber also comprising an inlet and an outlet. Only the inlet of the piston chamber which is connected to the main container comprises a non-return valve. The remaining valves are active valves which are operated by the control part. In particular, the valve in the inlet of the piston chamber of the piston pump which is connected to the main container is a valve with many disadvantages.

During use, upward movement of the piston will draw material from the auxiliary container into said piston chamber until the latter is full. When material has to be dispensed the piston is moved downwards. However, during the dispensing a substantial part of the contents of the piston chamber is forced back into the auxiliary container by way of the grooves 104. During the following upward stroke of the piston a considerable vacuum occurs in said piston chamber, but in the first instance this vacuum cannot be compensated for by drawing material from the auxiliary container. Material is much more likely to be drawn in from the piston chamber of the piston pump connected to the main container, or air is more likely to be drawn into the piston chamber by way of the piston. This has very undesirable consequences, since it is generally very undesirable in practice if the materials to be dispensed from the main container and the auxiliary container come into contact with each other or with air prior to dispensing. This also means that it is difficult to set the ratio between the components to be dispensed.

It emerges clearly from the above that, although aerosols for dispensing multi-component material are known in the prior art, all of them has considerable disadvantages, which stand in the way of a flexible, lasting and reproducible use of the aerosol in practice.

The object of the present invention is to provide an aerosol of the type mentioned in the preamble which does not have the abovementioned disadvantages and has generally improved characteristics. For this purpose, in a first aspect according to the invention provision is made for an aerosol intended for dispensing several components for the production of a multi-component material, in particular a paste-like cosmetic material, at least comprising a dispensing assembly, a main container and one or more separate auxiliary containers for components to be dispensed, in which the one or more auxiliary containers are accommodated in the main container and designed in such a way that they can be removed from the main container together with the dispensing assembly, in which the dispensing assembly comprises piston pumps for pumping the components to be dispensed out of the containers to one or more dispensing openings, a common control part being present for operating the piston pumps, in which the piston pumps comprise a piston chamber with an inlet and an outlet and a piston which is movable in the piston chamber, while a non-return valve is present in the inlet and the outlet of the piston chambers of the piston pumps, in which the non-return valve in the inlet of at least one of the piston chambers of the piston pumps which are connected to the auxiliary containers is in the form of a non-return ball check valve, and in which at least one of the auxiliary containers is in the form of a container with variable volume.

The aerosol according to the invention has the advantages of the aerosols of the prior art discussed earlier, but not the disadvantages. The aerosol is not limited to dispensing a special multi-component material, and can be used in many different fields. The use of a non-return ball check valve in the inlet of the piston chamber of at least one piston pump connected to an auxiliary container ensures that a substantially unambiguous separation between the component in the auxiliary container and the remaining contents of the aerosol is obtained and that the quantity of component to be dispensed from the auxiliary container can then also be regulated very accurately and in a reproducible manner. The quantity of component from the auxiliary container to be added to the component from the main container is often relatively small. For the auxiliary container usually contains a reactive component which must not come into contact with the component from the main container or the environment until the material is being dispensed. For example, in the case of many cosmetic products enzymes which are activated by means of water are used. Therefore, when the container is not in use, water from the main container must, of course, be prevented from coming into contact with the enzyme in the auxiliary container. It is also advantageous if the quantity of reactive component can be set accurately.

The piston pumps always start up simultaneously during dispensing, and a fixed ratio between the components to be dispensed is always obtained in a very reliable way.

With the aerosol according to the present invention it is possible to give the main container a desired aesthetically designed appearance without the latter being hampered by technical requirements, which is very important in the cosmetics field in particular.

A ball check valve is a non-return valve comprising a ball which can provide the desired valve action by interaction with a suitably shaped seat. The ball is preferably under a slight preload, for example by means of a spring acting upon it. If a ball valve without preload is used, it is preferable to fit suitable position-limiting means, which serve to ensure that the ball cannot move too far out of the seat, for example into the piston chamber, and thus serve to limit the freedom of movement of the ball. These positioning means can be, for example, suitably designed lugs or similar projections.

Multi-component materials are often used in the case of cosmetic products, toothpaste, adhesives, paints etc. The present invention is not limited to any of the above materials, but for the sake of clarity the remainder of the description will refer in the main to paste-like cosmetic material, in particular rejuvenation products based on enzymes.

The aerosol according to the invention not only produces the abovementioned advantages, but also makes it possible to use a standard aerosol in which a dispensing assembly according to the invention with one or more auxiliary containers is accommodated.

The components to be dispensed with the aerosol according to the invention are not particularly limited, and can comprise both liquid and gaseous components. The components themselves can also consist of several constituents. The components can be dispensed from different dispensing openings. It is also possible for the components to be mixed beforehand in a mixing chamber or in an outflow channel prior to dispensing from a common dispensing opening. This mixing can be carried out in a mixing chamber specially provided for the purpose or by so-called mixing vanes or mixing ribs in the outflow channel. In other words, the mixing of the components concerned can be carried out before, during or after dispensing thereof.

The piston pumps are in particular concentric piston pumps. It is most preferable to have the same number of piston pumps as components to be dispensed.

The aerosol preferably contains one auxiliary container. A very simple construction of the aerosol with relatively few parts is obtained in this way. Moreover, only two components are generally used, these components being mixed with each other only during or just prior to dispensing.

In particular, one or more of the non-return valves present are placed under a suitable preload, so that material is allowed through only above a certain pressure. This ensures that should a vacuum occur in the environment, for example in an aircraft, the contents of the container concerned do not escape from the aerosol. It is advantageous for the preloading of the non-return valves in the outlet of the piston chambers to be directed in the envisaged outflow direction, and for the dispensing assembly to comprise means which open said valves during dispensing for use of the aerosol. An example of this could be a ball which is forced by a spring into a seat and which can be released by a pin or the like on the control part, in which case the pin can be designed in such a way that, for example during use, it can be moved relative to the remainder of the assembly in order to force the ball out of the seat.

At least one of the auxiliary containers is preferably a container with variable volume. Examples of this are containers with a freely movable piston, tubes, balloons, bags etc. It is particularly preferable for all auxiliary containers to be containers with variable volume.

Containers with variable volume can be emptied by means of the piston pump intended for the purpose without the volume of material removed from the auxiliary container having to be replenished with air or the like, as is often the case with conventional aerosols. During dispensing of the component from said auxiliary container the piston moves in the direction of the pump and the volume of the container consequently decreases.

In a special preferred embodiment of the aerosol according to the invention the pumps concerned are also designed in such a way that the ratio between the volume of main component to be displaced per pump stroke and the volume of auxiliary component is at least 1:1, preferably 5:1, and most preferably 10:1.

It is particularly advantageous if each non-return valve in the inlet of a piston chamber of a piston pump connected to a container comprises a non-return ball check valve.

In another aspect the present invention provides for an aerosol which is intended for dispensing several components in foam form for the production of a multi-component foam material, in particular a paste-like cosmetic foam, at least comprising a dispensing assembly, a main container and one or more auxiliary containers for components to be dispensed, which dispensing assembly comprises dispensing means for conveying the components to be dispensed out of the containers to one or more dispensing openings, and a control part is present for operating the dispensing means, while air pumping means, mixing means and foam-forming means are also present for mixing the components with air prior to dispensing and foaming thereof for the formation of a foam.

The components can be forced out of the containers concerned by means of a propellant, which containers can be placed in communication with an outflow opening by means of suitable valves, while air is mixed in during the propelling and the mixture formed in this way with the foam-forming means is foamed. Foam-forming means can be, for example, sieves or other porous parts. The air pumping means can be in the form of a separate container already under air pressure or to be placed under air pressure, or in the form of an air pump which can supply air to the components during dispensing.

Instead of propellant, other ways of dispensing the components can also be applied, for example piston pumps, positive-displacement pumps, pressure pumps, and all other suitable pumps known in this field.

Although this aerosol can be designed in many different ways and, by slight adaptation of existing aerosols, the inventive idea on which it is based is suitable for dispensing several components, the dispensing assembly, the main container and the one or more auxiliary containers are advantageously designed as defined earlier for the aerosol intended for dispensing several components according to the invention.

In this case the air pumping means are preferably in the form of an air piston pump which is concentric with the remaining piston pumps and is designed to mix air as a component with several liquid components, thus forming a foam.

In a third aspect the invention provides an auxiliary container intended for an aerosol according to the invention.

The auxiliary container advantageously comprises a breakable membrane which can be broken by connection to the dispensing assembly. The presence of a membrane guarantees the quality of the contents of the auxiliary container and prevents any reactive materials which may be present therein from being able to come into contact with the environment.

In a special embodiment of the auxiliary container, said container is designed in such a way that, depending on the contents thereof, it can make a unique connection to the dispensing assembly. In this way it can be ensured that when an aerosol with certain contents in the main container is used an auxiliary container with unsuitable contents is not accommodated therein.

The dimensions of the part of the auxiliary container to be connected to the dispensing means are preferably unique depending on the contents thereof.

In a fourth aspect the present invention also provides a dispensing assembly intended for an aerosol according to the invention. The dispensing assembly is advantageously provided with means for breaking a membrane of an auxiliary container to be connected thereto.

The present invention will now be explained in greater detail with reference to the appended drawing, in which.

Figure 5:
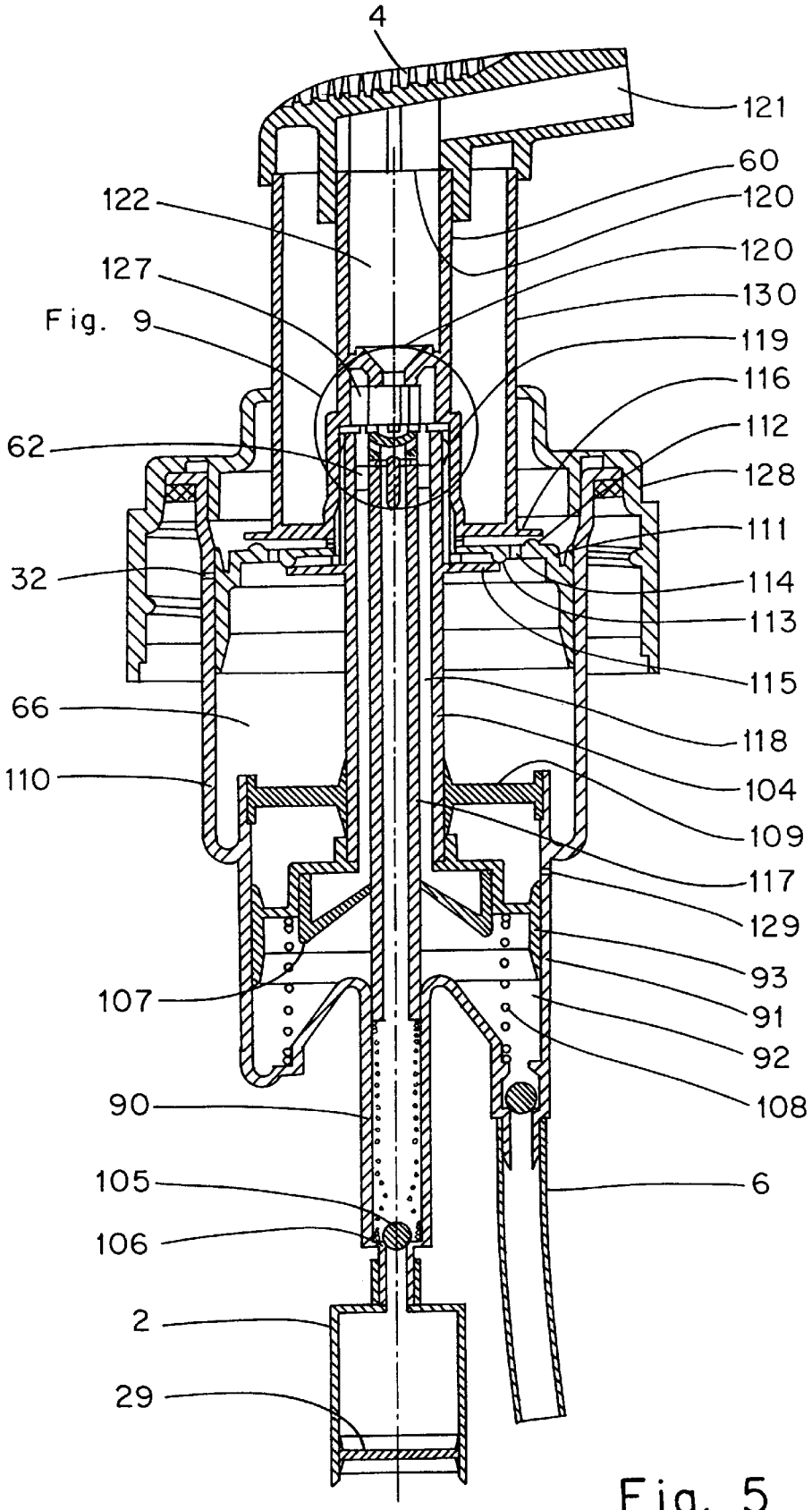
FIG. 5 shows a modified embodiment of the aerosol according to FIG. 4, suitable for dispensing foam.
Figure 8B:
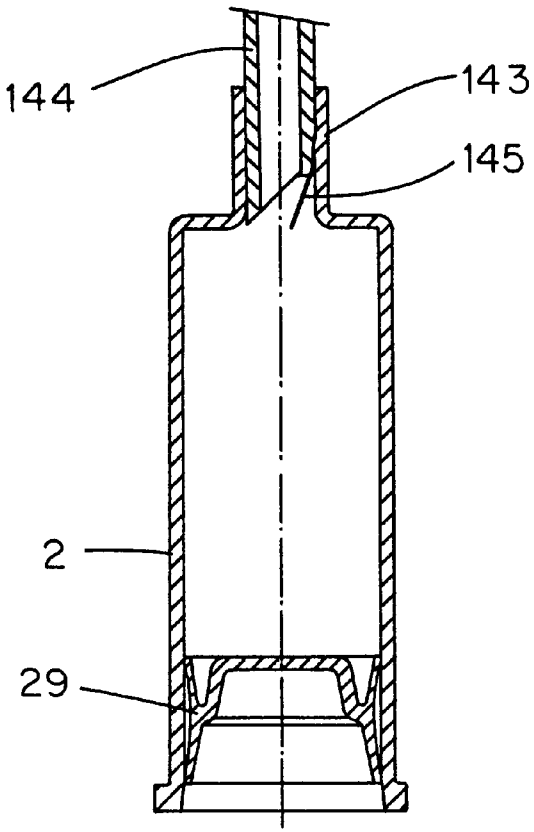
Figure 8A:
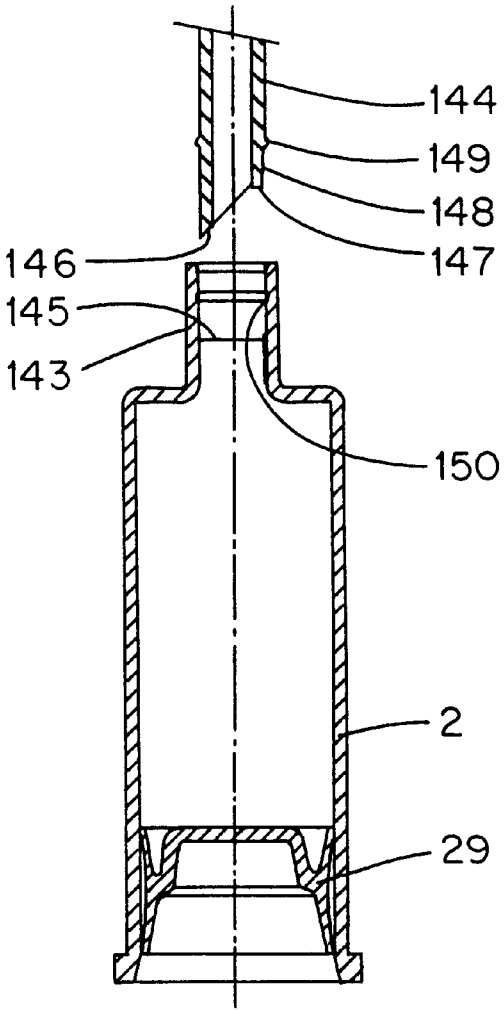
Figure 9:
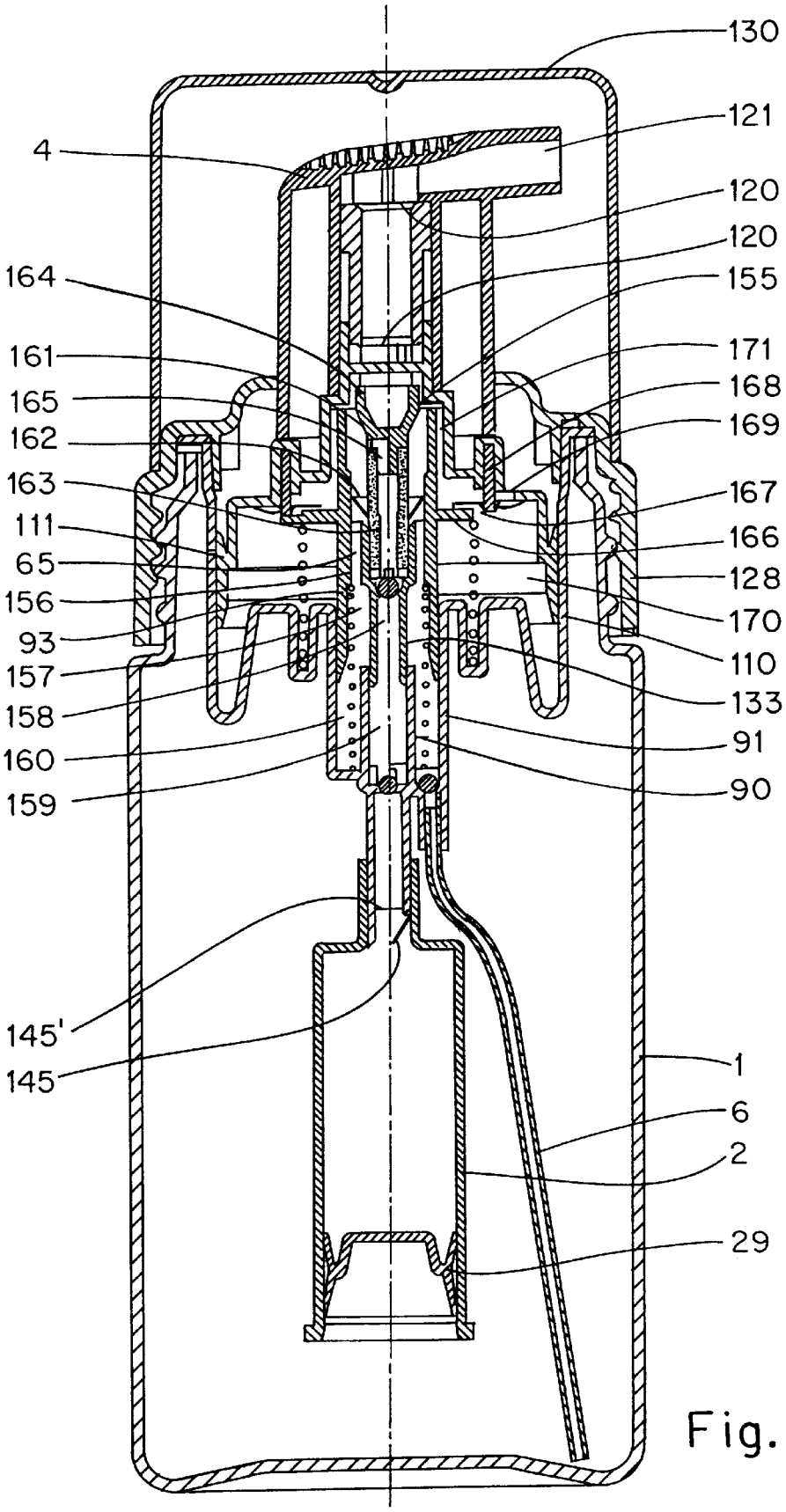

FIGS. 8*a* and 8*b* show an enlarged view of an auxiliary container with closed and broken membrane; and FIG. 9 shows a modified embodiment of the aerosol according to FIG. 5.

Figure 1:
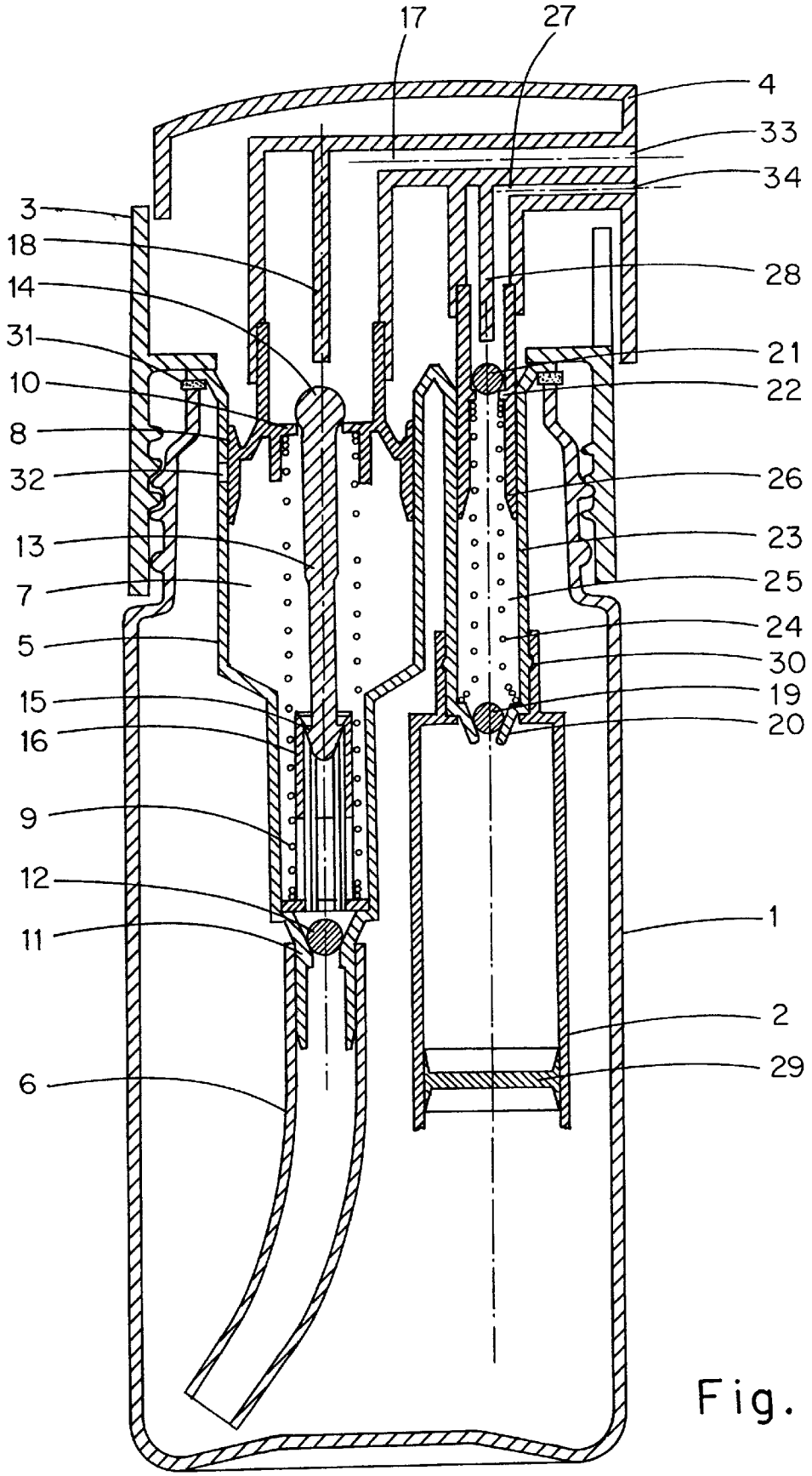
FIG. 1 shows a first embodiment of an aerosol according to the invention, with a main container and an auxiliary container, in section.

The aerosol shown in FIG. 1 comprises a main container 1 which has a dispensing assembly with an auxiliary container 2 fixed therein, a fixing collar 3 being screwed on the main container 1, which collar serves for fixing of the dispensing assembly. The dispensing assembly comprises two piston pumps 5 and 23, for pumping material out of the main container 1 and the auxiliary container 2 respectively, and a common control part 4.

The piston pump 5 is connected to a riser tube 6 which extends near to the bottom of the main container 1. The pump 5 comprises a piston chamber 7, container a piston 8 which is movable by the control part 4 and interacts with a resetting spring 9. The piston pump 5 comprises a non-return valve in the inlet of the piston chamber 7, consisting of a ball 12 which interacts with a seat 11 and serves to draw the component out of the main container into the piston chamber 7, but to prevent it from flowing back into the main container through the riser tube 6. A second non-return valve is also present at the outflow side or the outlet of the piston chamber 7 of the piston pump 5, which valve comprises an actively operated elongated closing element 13 which interacts with a seat 10. This element 13 comprises a spherical sealing element 14 at one end and a collar 15 at the other end. Said collar can interact with a limiting element 16 which supports the spring 9 and is provided with openings in the periphery thereof. The limiting element is fixed in the bottom of the piston chamber 7.

When the aerosol is being used, the control part 4 will be pressed downwards, with the result that the piston chamber 7 is emptied by means of the piston 8 into the channel 17. The spherical part 14 leaves the seat 10, and material can leave the aerosol through the outflow channel 17 of the control part 4. During the downward movement of the control part 4 a rod-shaped part 18 comes into contact with the spherical part 14 of the closing element, which limits the movement of the closing element 13. The piston chamber also comprises an opening 32 which serves for ventilating the main container 1 at the moment when the piston 8 releases said opening.

The pump 23 of the auxiliary container 2 is correspondingly designed and comprises two non-return ball check valves, one in the inlet and one in the outlet of the piston chamber 25: a ball 19 which interacts with a seat 20, and a ball 21 which interacts with a seat 22. The freedom of movement of the ball 19 is limited by the spring 25, and the freedom of movement of the ball 21 by a rod 28 which is integral with the control part 4. The pump 23 of the auxiliary container 2 likewise comprises a piston chamber 25, a piston 26 and a spring 24.

The control part 4 comprises separate outflow channels 17, 27 for separate dispensing of the components from the containers 1, 2.

The outflow channel 17 comprises a dispensing opening 33 which extends substantially around a dispensing opening 34 of the outflow channel 27, the latter being disposed eccentrically. The above provides aesthetic advantages, because in this way if the material from the auxiliary container is a different colour, a material with a stripe can be dispensed.

The auxiliary container 2 is a container with variable volume and comprises a freely movable piston 29 which will move in the direction of the pump 23 when the auxiliary container 2 is being emptied. The above is advantageous because the volume of material removed from the auxiliary container 2 need not be replenished with air or the like. The component which has to be added in small quantities to a main component is often susceptible to external influences, such as air, moisture etc. The auxiliary container 2 in this case is screwed or snapped onto the pump 23 at 30. The method of connection between the container 2 and the pump 23 and the choice of dimensions and the like are advantageously unique for each component, so that incorrect use of components is ruled out.

In the case of this embodiment according to FIG. 1 the pumps 5 and 23 are in the form of a pump assembly, which is fixed by the fixing collar 3 on the main container 1, with the interposition of a sealing ring 31.

Although in this embodiment the control part 4 comprises a nozzle with two separate dispensing openings 33 and 34, it is, of course, possible to connect the two pumps to a common dispensing opening, possibly with the interposition of a mixing chamber or mixing vanes or the like in a common outflow channel. The ratio between the quantities of components to be dispensed from main and auxiliary container can also easily be set by a suitable choice of the dimensions of the pumps.

With the aerosol according to FIG. 1 it is possible to remove the dispensing assembly with the auxiliary container 2 from the main container 1. This can be advantageous if, for example, one wishes to mix another auxiliary component with the main component, so that another auxiliary container needs to be attached. This can also be advantageous during the first use, because it means that the aerosol can be supplied with, for example, separately added auxiliary containers which can be fitted as desired on the dispensing assembly.

Figure 2:
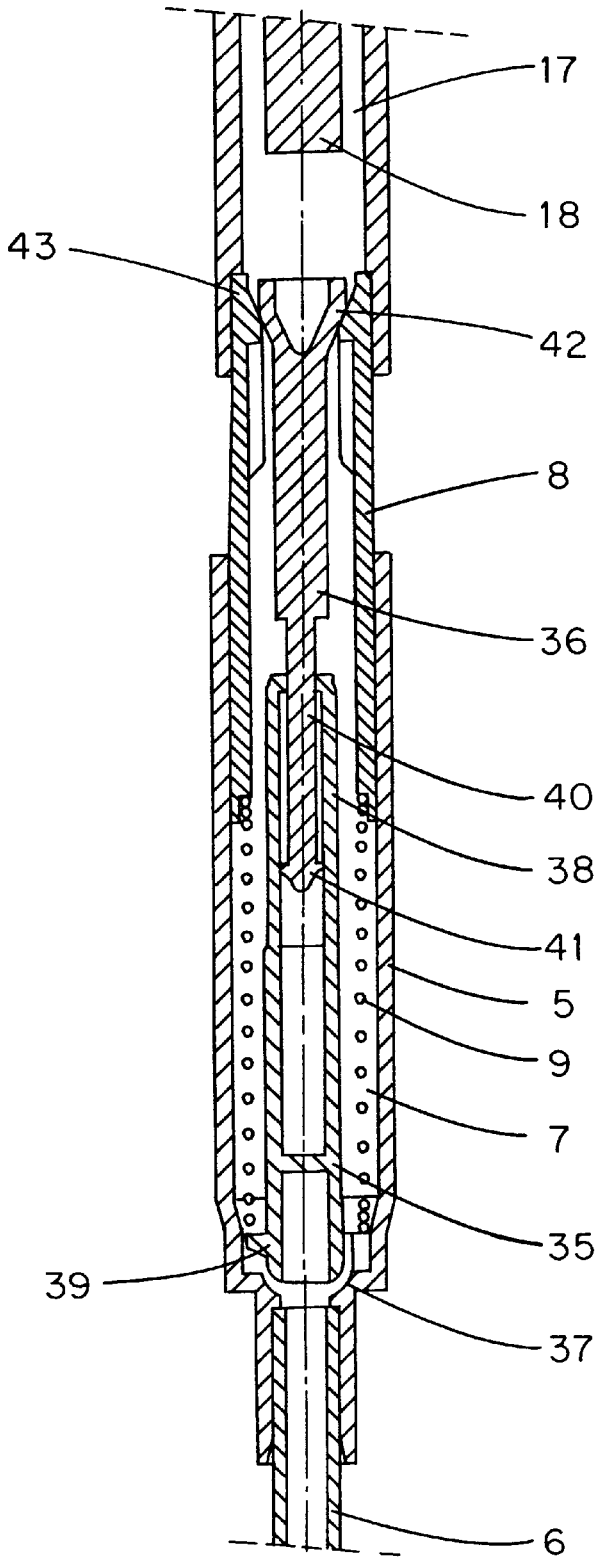
FIG. 2 shows a special embodiment of the piston pump for the main container according to FIG. 1.

FIG. 2 shows a special embodiment of the pump 5 of the aerosol according to FIG. 1, in which corresponding parts have been indicated by corresponding reference numbers. In the case of this pump, apart from the conventional parts, such as the piston chamber 7 and the piston 8, a sealing element 35 is present, which sealing element can interact with a sealing element 36. The sealing element 35 can also interact with a seat 37 in the inlet of the piston chamber 7, in order to interrupt the communication between the piston chamber 7 and the main container when material is being dispensed.

The sealing element 35 comprises an elongated cylindrical part 38 which is open at one end, and at the closed end has a sealing part 39 which can interact with the seat 37. The sealing element 36 comprises a rod-shaped part 40, which at the end is provided with lips 41, which under friction can interact with the inside of the cylindrical part 38 of the sealing element 35. The sealing element 36 also comprises a widened end 42, which can interact with a seat 43 in the outlet of the piston chamber 7, in order to shut the piston chamber 7 off from the environment, i.e. the outflow channel 17, when said piston chamber is being filled.

When the piston chamber has been emptied, the rod-shaped part 40 has moved downwards in the cylindrical part 38, and on the return movement of the pump will lift the sealing element 35 off the seat 37, so that material can be drawn out of the main container 1 into the piston chamber 7.

Figure 3:
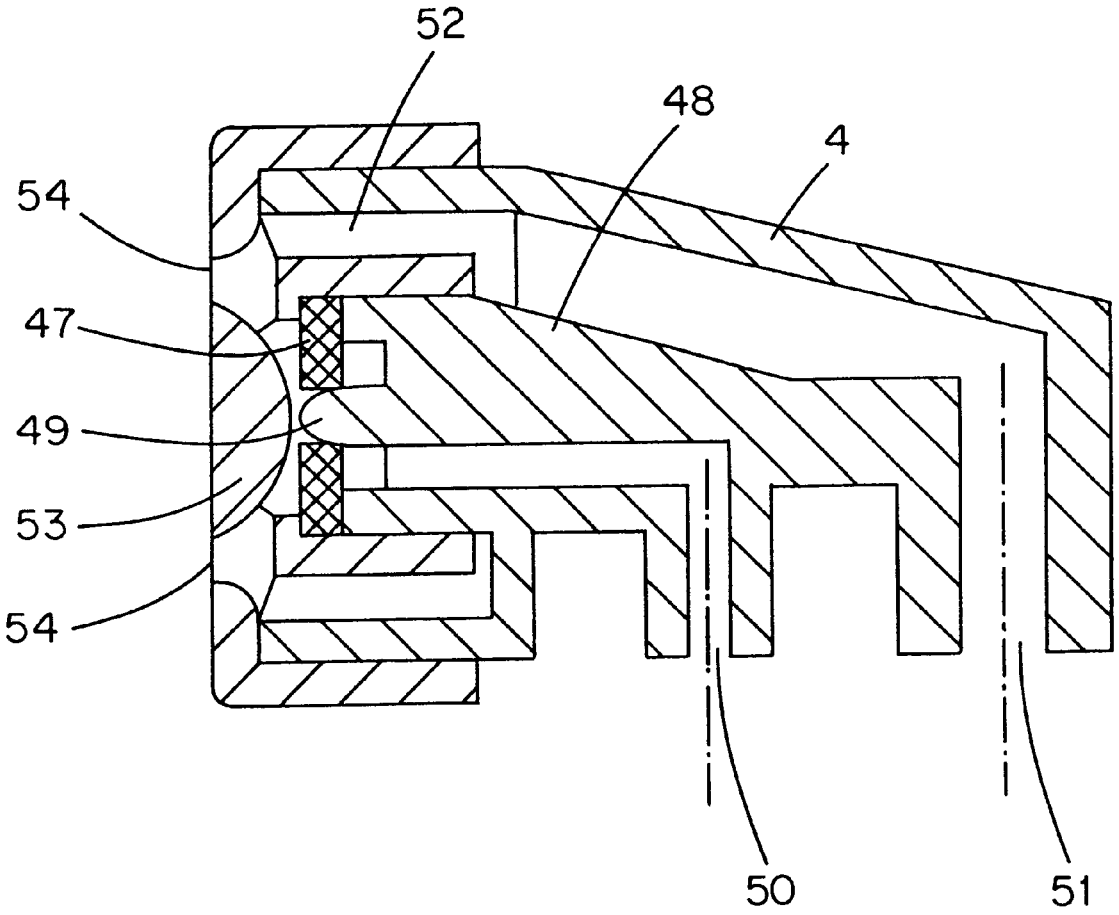
FIG. 3 shows a special embodiment of the control part of the aerosol according to FIG. 1, in section.

FIG. 3 shows a special embodiment of the control part 4, in which the dispensing opening for one of the components comprises a non-return valve which has a sealing element 48 in the opening of a sealing ring 47, which element interacts therewith to form a seal, while the sealing ring is fixed on the element 48, forming a seal on the periphery. The element 48 comprises a projection 49 which extends into the opening of the sealing ring 47. In this embodiment two outflow channels 50 and 51 are present, opening out at the sealing ring 47 and in an annular chamber 52 around the element 48 respectively. Situated just in front of the projection 49 is a hemispherical distribution element 53, which serves for distribution of the material supplied through the channel 50, which material can mix with material supplied through the annular chamber 52 prior to dispensing from the dispensing openings 54. It is therefore made possible for the components to be dispensed in an aesthetically attractive way, i.e., for example, coloured stripes or other patterns of an auxiliary component in a main component. It will be clear that this embodiment is suitable for, for example, fitting on the aerosol of FIG. 1, in which case the non-return valve is accommodated in the outflow channel of the auxiliary component.

The projection 49 and the sealing ring 47 are preferably situated as close as possible to dispensing openings 54, in order to make the dead space past the sealing ring 47 as small as possible.

Figure 4:
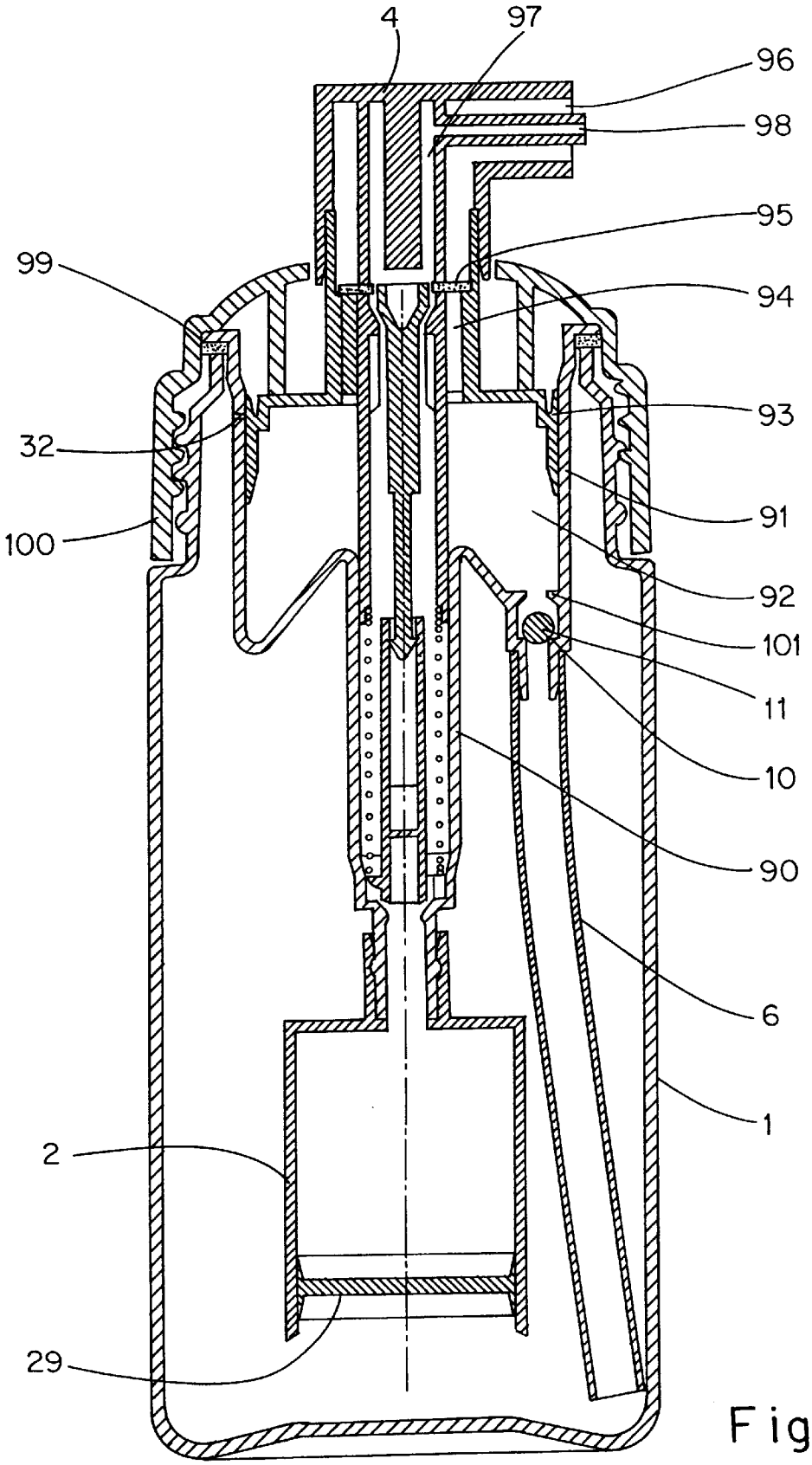
FIG. 4 shows an embodiment of the aerosol according to the invention with a combined concentric pump assembly.

FIG. 4 shows an embodiment of the aerosol according to the invention comprising a main container 1 and an auxiliary container 2, the latter comprising a freely movable piston 29. The two containers 1 and 2 are each connected to their own piston pump, but in this case the two pumps are concentric piston pumps. A pump 90 for the auxiliary container 2 works in a manner corresponding to that of the pump shown in FIG. 2 and will therefore not be discussed further. A pump 91 for the main container 1 comprises a piston chamber 92 and an annular piston 93 which is freely movable therein and is connected to the piston of the pump 90. Channels 94, which are closed off by a sealing ring 95 acting as a non-return valve, are also present. The sealing ring 95 is fixed around the opening thereof and when material is being dispensed to the outside can bulge out near the periphery, and in this way clear the passage, with the result that the channels 94 are placed in communication with an annular dispensing opening 96. Material can be pumped by means of the pump 90 out of the container 2 through a channel 97 to a central dispensing opening 98.

In the case of the non-return ball check valve in the inlet of the piston chamber 92, comprising the ball 11 and the seat 10, lugs 101 are situated above the ball, in order to prevent the ball from moving in the piston chamber 92 during filling of said piston chamber 92. Furthermore, a ventilation opening 32 is again present in the wall of the piston chamber 92, for ventilating the main container 1.

In this case the entire dispensing assembly with the auxiliary container 2 is fixed on the main container by means of a screw cap 100, with the interposition of a sealing ring 99.

FIG. 5 shows an embodiment of a dispensing assembly for an aerosol according to the invention, which assembly is intended for mixing two components with air, for the dispensing of a foam. Said aerosol basically comprises the pump assembly according to FIG. 4. A piston pump for the auxiliary container 2, a piston pump for the main container 1, and a piston pump 110 with a piston chamber 66 for pumping air are present in this case. All pumps are concentric here also. The pump 90 for pumping material out of the auxiliary container 2 comprises as a non-return valve in the inlet of the piston chamber 92 a ball 105 which can interact with a seat 106, instead of the assembly of sealing elements 35 and 36 according to FIG. 4.

The piston 93 likewise comprises an annular central auxiliary piston 107, which is disposed in such a way that it is slidable around a hollow piston 117 of the piston pump 90, thereby producing a seal, and interacts with a spring 108. The pump 91 comprises at the top side a sealing ring in the form of an annular fixed piston 109 which is slidable around a hollow piston rod 104 of the piston 93, thereby producing a seal. The additional piston pump 110 for pumping air is present above said piston 109. Said piston pump 110 comprises an annular piston 111 with a circumferential sealing rib 112 disposed near the outside edge thereof and extending in the envisaged outflow direction, and a circumferential rib 113 situated further inwards, viewed in the radial direction, and extending in the opposite direction, and passages 114 present between said sealing ribs. The sealing ribs 112 and 113 can interact and form a seal with circumferential flange stops 115 and 116. The flange stop 116 is present on a control cylinder 60 which forms part of the control part 4 for operating the piston pumps, and the flange stop 115 is present on the piston rod 104.

The piston 117 of the pump 90 and the piston rod 104 of the piston 93 are fixed in the control cylinder 60. Passages 119 are present between said piston 104 and the control cylinder 60, for conveying the material out of the piston chamber 92 of the pump 91. This space is formed by suitable lugs or ribs on one or both of the parts. Moreover, passages 118 are likewise present between the piston rod 104 and the piston 117, possibly in the form of an annular channel.

When the aerosol is being used, during the dispensing the sealing rib 112 on the piston 111 will form a seal against the annular flange stop 116, and air will be able to pass through between sealing rib 113 and the flange stop 115 to the passages 119. The components from the main container and auxiliary container meet with air in the mixing chamber 127 and are mixed there, after which a foam is formed with the aid of suitable foam-forming means.

Figure 6:
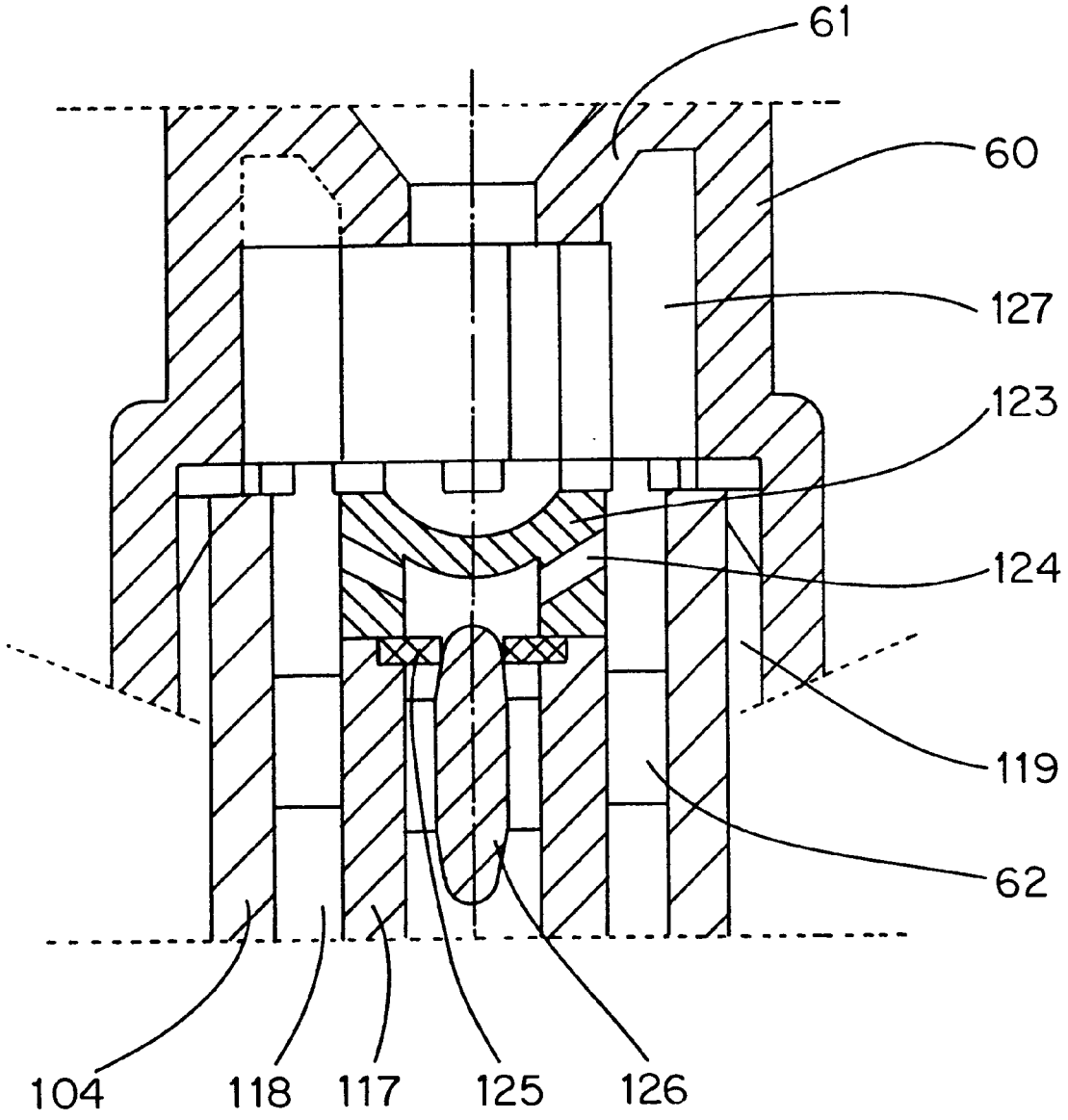
FIG. 6 shows an enlarged elevational view of the part indicated by a circle in FIG. 5.

FIG. 6 shows an enlarged detail of the encircled part of FIG. 5. Clearly visible are the control cylinder 60, the piston rod 104 and the piston 117 with the channel 118 present between them, and also the passages 119 for the supply of air between the piston rod 104 and the control cylinder 60.

The control part 4 comprises a through-going central channel 122 in the control cylinder 60, which channel is provided locally with an inward directed annular shoulder, so that the control cylinder 60 can rest by means of said shoulder on the piston rod 104, with the interposition of lugs or grooves in one of the two parts.

The piston 117 is connected to the piston rod 104 by means of connecting bridges 62, which also serve as spacers for forming the annular channel 118.

At the end closest to the control cylinder 60, the piston 117 is provided with a cap 123 with peripheral openings 124 which are directed obliquely upwards in the outflow direction. The presence of these radially directed openings 124 ensures that very good mixing between the two components which are fed in can be obtained. The mixture formed in this way enters the channel 122 in the form of a cylindrical column, which column at right angles thereto is met by air supplied through passages 119, which produces very good mixing. In this connection attention is drawn to EP-A-0 483 240.

Near said cap 123, just below the openings 124, a sealing ring 125 is present in the control piston 117, which sealing ring can interact with a sealing element 126 which is fixed by ribs in the piston 117 below said ring 125 and can interact to form a seal with the ring 125 in the opening thereof. In this way a non-return valve is present in the outlet of the piston chamber of the pump 90, which valve prevents the material from the auxiliary container from being able to come into contact with the environment or with material from the main container.

The mixture of the components from the main container and the auxiliary container 2 is advantageously mixed with air in a ratio of approximately 1:10.

The entire dispensing assembly with the auxiliary container can be fixed on a main container by means of a fixing cap 128. A ventilation opening for ventilating the space between the piston 109 and the movable piston 93 of the pump 91 is indicated by 129. Said ventilation opening can also be omitted, in which case the spring 108 can likewise be omitted, and the space above the piston 93 in that case acts as a vacuum spring.

When the pump assembly is used for dispensing foam and the control part 4 is released, the pump 110 will be filled with air again, through the fact that the annular sealing rib 113 produces a seal against the stop 115, and air between the fixing cap 128 and the outside wall 130 of the control part 4 can move through between the sealing rib 112 and the flange stop 116 and then pass through the openings 114 in the piston 111 into the piston chamber of the air piston pump 110.

Figure 7:
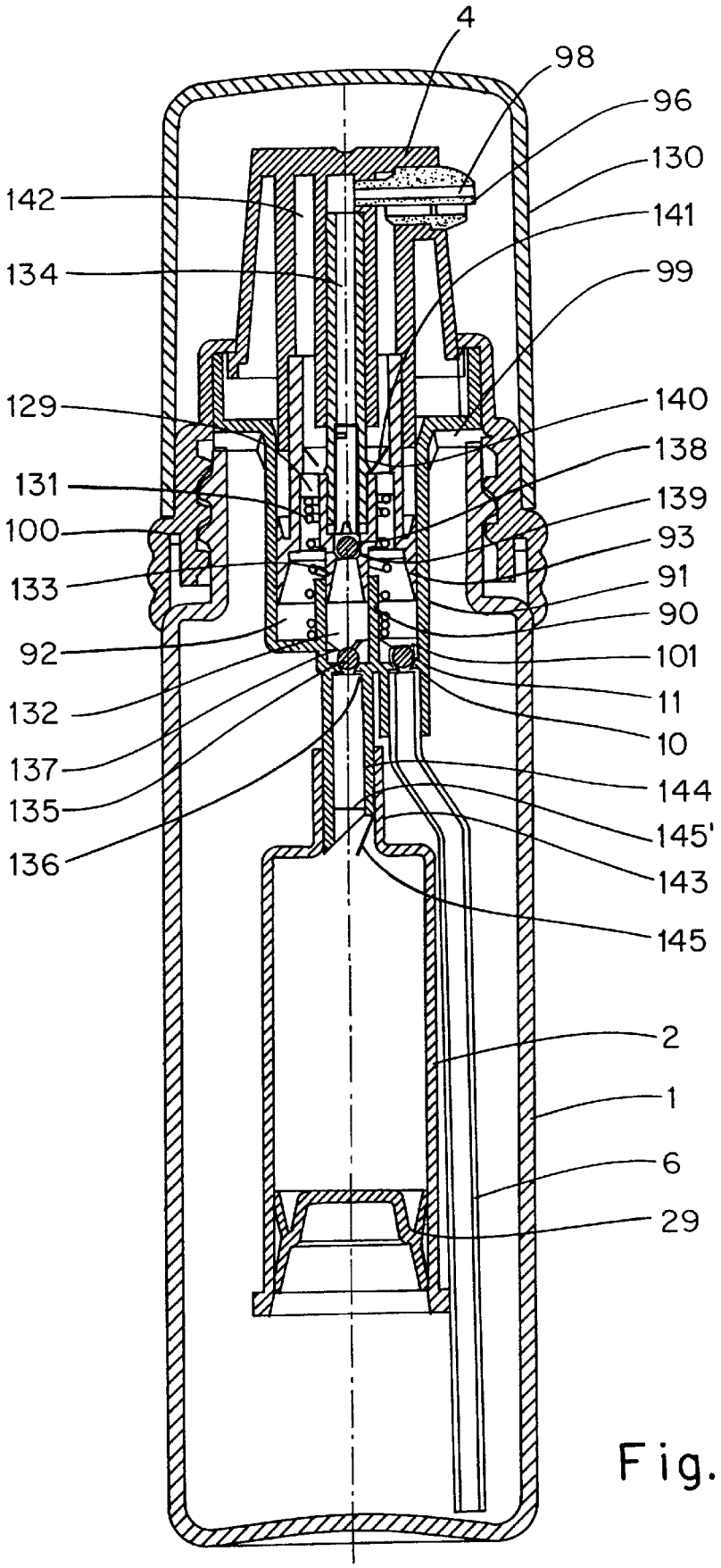
FIG. 7 shows another modified embodiment of the aerosol according to FIG. 4.

FIG. 7 shows an embodiment of an aerosol which largely corresponds to that according to FIG. 4. Corresponding parts are therefore indicated by the same reference numbers. The aerosol comprises a main container 1 and an auxiliary container 2. A cap 130 is also shown. The auxiliary container is connected to a pump 90 which comprises a piston chamber 132 and a piston 133. The piston 133 is a hollow piston which can be placed in communication with the dispensing opening 98 by means of a channel 134, and said dispensing opening is also connected to the control part 4.

A ball 135 is present in the piston chamber 132 between a seat 136 and lugs 137. Said ball serves as the non-return ball check valve in the inlet of the piston chamber 132. The piston 133 also comprises a non-return valve, comprising a ball 138 between a seat 139 in the piston 133 and a spring 140 which is present in the outlet of the piston chamber 132. The spring 140 serves to give a certain preload to the ball 135, so that if a vacuum occurs in the environment, for example in an aircraft, material is prevented from escaping from the aerosol.

The piston 133 also comprises an additional sealing collar 141, which serves as a non-return valve under preload in the outlet of the piston chamber 142 of the pump 91 for pumping material out of the main container 1. The piston pump 91 comprises a hollow piston 93 which is likewise connected to the control part 4 and which can be placed in communication with the dispensing opening 96 by way of a channel 142.

Reference number 131 indicates a spring which rests on the underside of the piston chamber 92 and connecting bridges 129 on the piston 93. Said spring 131 serves as a restoring means for the control part of the two pumps 90 and 91. The connecting bridges 129 connect the piston 93 to the piston 133 and ensure the correct mutual distance for the formation of a channel between them.

Both dispensing openings 96 and 98 are disposed eccentrically, so that a striped product can be dispensed if materials of different colours are being dispensed.

The auxiliary container 2 comprises a coupling neck 143 which can be snapped onto a bevelled connecting bush 144. Reference number 145 shows a broken membrane, and 145' shows the original state of the membrane 145. The type and the mode of operation of the connecting bush 144 and the membrane 145 will be explained in greater detail in FIG. 8.

FIGS. 8*a* and 8*b* show an embodiment of the connection between the connecting bush 144 of the dispensing assembly and the neck 143 of the auxiliary container 2, in which the auxiliary container 2 comprises a breakable membrane 145 which is still closed in FIG. 8*a* and has been opened in FIG. 8*b*. The connecting bush 144 comprises a bevelled end 146, but said end is not sharp over the entire periphery thereof. At 147 it is, in fact, blunt. This means that during connection of the connecting bush to the neck 143 of the auxiliary container 2 the membrane 145 is opened by the sharp edge 146, while the blunt part prevents the membrane from becoming completely detached and, for example, possibly blocking a channel.

A recess 148 is also present in the connecting bush 144, in order to promote the lateral movement of the membrane 145 out of the flow path during opening. After opening of the membrane, the latter is wedged between the recess 148 and the inside wall of the neck 143 of the auxiliary container 2.

A collar 149 is present on the connecting bush 144, which collar can interact in a snapping manner with an annular recess 150 in the inside wall of the neck 143 of the auxiliary container 2.

As can be seen clearly from FIG. 8, it is preferable to make the thickness of the membrane increase towards the periphery. This guarantees a seal of the auxiliary container 2 which is easy to open, but is still very reliable.

Finally, FIG. 9 shows a slightly modified embodiment of the aerosol according to FIG. 5, for dispensing foam by mixing two components with air. Corresponding parts are indicated by the same reference numbers.

Just as in the case of the embodiment according to FIG. 7, an important difference again from the other embodiments discussed is that non-return valves which are under a suitable preload are present, in order to prevent material from leaving the containers should external vacuum occur.

The dispensing assembly according to this embodiment comprises three pumps, a piston pump 90 for pumping material out of the auxiliary container 2, a piston pump 91 for pumping material out of the main container 1, and a piston pump 110 for air. The three constituents can be mixed with each other in a mixing chamber 155, passed through sieves 120 and foamed, and dispensed through a dispensing opening 121.

The pumps 90, 91 and 110 are disposed concentrically and comprise a combined common piston 156. The piston 156 comprises passages 171 for conveying air to the mixing chamber 155, an annular channel 157 for taking material from the main container 1 to the mixing chamber 155, and a middle channel 158 for taking material from the auxiliary container 2 to the mixing chamber 155. The pump 90 comprises a piston chamber 159, and the pump 91 a piston chamber 160. The piston 156 comprises the piston 133 of the pump 90 and the piston 93 of the pump 91. The annular channel 157 and passages 65 are present between said pistons 93 and 133.

A sealing part 163 forms part of the piston 133 and comprises a cup-shaped attachment 164 with a lateral passage 165 under the bottom of the cup-shaped attachment 164, which passage can be placed in communication with the middle channel 158. The sealing part 163 also comprises two sealing collars 161 and 162 which serve as non-return valves under slight preload for the pump 90 and the pump 91 respectively. The sealing collar 161 interacts with the opening 165 in the cup-shaped attachment 164, and the sealing collar 162 interacts with the inside wall of the piston 93.

The piston chamber 159 both at the inlet and at the outlet comprises a non-return ball check valve with a ball between a seat and limiting lugs, the mode of operation of which has already been explained with reference to other embodiments.

The combined piston 156 also comprises a circumferential flange 166 which at the periphery thereof is provided locally with recesses 167. Said flange 166 interacts with an annular sealing element 168 with dual function. Said sealing element 168 forms a non-return valve for an inlet opening 169 in the air piston 111 for the admission of air into the air piston chamber 170, and likewise works to allow air to flow out of the chamber 170 to channels 171 between the air piston 111 and the combined piston 156. Air can flow through the channels 171 into the mixing chamber 155, in order to mix there with other components.

The air piston 111 is connected to the combined piston 156, but in such a way that, through the presence of lugs and the like on at least one of the two parts, the channels 171 are formed between the two parts.

It will be clear that in all the above exemplary embodiments in which channels or passages are present between two parts, said channels or passages can be formed as such, or by providing grooves and/or lugs on one of the two parts prior to connecting said parts.

The pump 91 for pumping material out of the main container 1 also comprises a non-return valve both at the inlet and at the outlet of the piston chamber 160, namely a non-return ball check valve with a ball, a seat and limiting lugs at the inlet at the side of the riser tube 6 and a non-return valve in the form of the sealing collar 162 at the outlet of the piston chamber 160 respectively. Just as in the case of the other pumps, the purpose of the non-return valves is to ensure that material can be drawn through the riser tube into the pump chamber 160 and then conveyed through the channel 157 and by way of the collar 162 into the mixing chamber 155.

The containers with variable volume and freely movable pistons described above can be replaced by any other suitable container with variable volume, such as bags, tubes, balloons etc.

All containers of the aerosol according to the invention can be made from a plastic which is oxygen-impermeable and is preferably also impervious to light, so that the components present in the containers, in particular those in the auxiliary containers, cannot lose their reactivity through external conditions. The remaining parts are advantageously also made of suitable plastic.

If the oxygen-impermeable material of the auxiliary container itself does not have the remaining desired properties, the auxiliary container can be made as a co-extruded tube from several layers, an internal layer of which is oxygen-impermeable, while the auxiliary container still possesses the required flexibility to allow its volume to be reduced.

I claim:

1. Aerosol intended for dispensing several components for the production of a multi-component material, in particular a paste-like cosmetic material, at least comprising a dispensing assembly, a main container (1) and one or more separate auxiliary containers for components to be dispensed, in which the one or more auxiliary containers are accommodated in the main container and designed in such a way that they can be removed from the main container together with the dispensing assembly, in which the dispensing assembly comprises piston pumps for pumping the components to be dispensed out of the containers to one or more dispensing openings, a common control part being present for operating the piston pumps, in which the piston pumps comprise a piston chamber (7, 25; 92, 66;) with an inlet and an outlet and a piston which is movable in the piston chamber (5, 23), while a non-return valve is present in the inlet and the outlet of the piston chambers of the piston pumps, in which the non-return valve in the inlet of at least one of the piston chambers of the piston pumps which are connected to the auxiliary containers is in the form of a non-return ball check valve, and in which at least one of the auxiliary containers is in the form of a container with variable volume.

2. Aerosol according to claim 1, characterized in that the aerosol contains one auxiliary container.

3. Aerosol according to claim 2, characterized in that the pumps concerned are designed in such a way that the ratio between the volume of main component to be displaced per pump stroke and the volume of auxiliary component is at least 1:1.

4. Aerosol according to claim 3, characterized in that the ratio between the volume of main component to be displaced per pump stroke and the volume of auxiliary component is at least 10:1.

5. Aerosol according to claim 1, characterized in that each non-return valve in the inlet of a piston chamber of a piston pump connected to a container comprises a non-return ball check valve.

6. Auxiliary container intended for an aerosol according to claim 1.

7. Auxiliary container according to claim 6, characterized in that the auxiliary container comprises a breakable membrane which can be broken by connection to the dispensing assembly.

8. Auxiliary container according to claim 7, characterized in that the auxiliary container is designed in such a way that, depending on the contents thereof, it can make a unique connection to the dispensing assembly.

9. Auxiliary container according to claim 8, characterized in that the dimensions of the part of the auxiliary container to be connected to the dispensing means are unique depending on the contents thereof.

10. Dispensing assembly intended for an aerosol according to claim 1.

11. Dispensing assembly according to claim 10, characterized in that the dispensing assembly is provided with means for breaking a membrane of an auxiliary container to be connected thereto.

12. Aerosol intended for dispensing several components in foam form for the production of a multi-component foam material, in particular a paste-like cosmetic foam, at least comprising a dispensing assembly, a main container and one or more auxiliary containers for components to be dispensed, which dispensing assembly comprises dispensing means for conveying the components to be dispensed out of the containers to one or more dispensing openings, and a control part is present for operating the dispensing means, while air pumping means, mixing means and foam-forming means are also present for mixing the components with air prior to dispensing and foaming thereof for the formation of a foam.

13. Aerosol according to claim 12, characterized in that the dispensing assembly, the main container and the one or more auxiliary containers are designed as defined in one or more of the preceding claims.

14. Aerosol according to claim 13, characterized in that the air pumping means are in the form of an air piston pump (110) which is concentric with the remaining piston pumps, and which is designed to mix air as a component with several liquid components, thus forming a foam.

* * * * *